United States Patent [19]

Brieger

[11] 3,934,468

[45] Jan. 27, 1976

[54] FORMATION-TESTING APPARATUS

[75] Inventor: Emmet F. Brieger, Nogal, N. Mex.

[73] Assignee: Schlumberger Technology Corporation, New York, N.Y.

[22] Filed: Jan. 22, 1975

[21] Appl. No.: 543,085

[52] U.S. Cl. ..... 73/155

[51] Int. Cl.[2] ..... E21B 47/10

[58] Field of Search ..... 73/151, 155, 421 R

[56] References Cited

UNITED STATES PATENTS

| | | | |
|---|---|---|---|
| 3,254,531 | 6/1966 | Briggs, Jr. | 73/155 |
| 3,677,080 | 7/1972 | Hallmark | 73/155 |

*Primary Examiner*—Jerry W. Myracle

*Attorney, Agent, or Firm*—Ernest R. Archambeau, Jr.; William R. Sherman; Stewart F. Moore

[57] ABSTRACT

In the representative embodiment of the new and improved formation-testing apparatus disclosed herein, a wall-engaging sealing pad is arranged around the forward end of a normally open tubular probe which is adapted to be placed in communication with an adjacent earth formation and carries an extendible filter probe coaxially supported therein by a tubular valve member. If a formation being tested is relatively incompetent, the filter probe will be advanced into the formation without allowing further erosion of loose formation materials with the valve member acting to block communication through the outer probe. Alternatively, should a formation being tested be relatively competent, the filter probe will remain in its normal retracted position and the valve member will cooperatively block communication through the filter probe and instead provide an unrestricted flow passage through the outer probe to a sample-collecting system on the apparatus.

18 Claims, 4 Drawing Figures

FORMATION-TESTING APPARATUS

Heretofore, the successful use of single-test wireline formation testers has generally depended upon knowing in advance the general character or stability of the particular formations which were to be tested. For example, where the formations to be tested are fairly competent and, therefore, not easily eroded during a test, prior-art testers such as that shown in Pat. No. 3,011,554 have been highly effective. On the other hand, where fairly incompentent or unconsolidated formations are to be tested, formation testers such as those shown in Pat. No. 3,352,361, Pat. No. 3,530,933, Pat. No. 3,565,169 or Pat. No. 3,653,436 have been employed heretofore. As fully described there, each of those prior-art testing tools employs a tubular sampling member which is cooperatively placed in serial communication with a filter. In this manner, erosion of the borehole wall is avoided by preventing the continued entrance of unconsolidated formation materials into the testing tool. Since all of these prior-art testers can be operated only during a single trip into the well bore, it has, of course, been necessary to select in advance the particular size or type of filter which is hopefully suited for that specific operation.

It will, however, be recognized that there are often situations where the exact character of a given formation which is to be tested simply cannot be predicted in advance. For instance, where one of these testers is equipped with a filter capable of stopping exceptionally fine formation materials, it is not at all uncommon for the small filter openings to become quickly plugged by the normally large particles of the mudcake which usually lines the borehole wall adjacent to a potentially producible formation. Thus, a test under these conditions will often be inconclusive, if not misleading, since it will not be known for sure whether the formation is truly unproductive or if the filter was simply plugged at the outset of the test. On the other hand, where the tester either has no filter or is equipped with a filter having large openings, there will often be an excessive induction of fine formation materials into the tester when the tool is testing a highly unconsolidated formation. This action will, therefore, frequently result in a continued and rapid erosion of the formation wall around the sealing pad so that isolated communication with the formation is quickly lost. This action, of course, also causes an incomplete or inconclusive test.

Accordingly, it is an object of the present invention to provide new and improved formation-testing apparatus for reliably obtaining a measurement of one or more fluid or formation characteristics as well as for selectively collecting a sample of connate fluids, as desired, from earth formations of different and unknown competencies.

This and other objects of the present invention are attained by providing formation-testing apparatus having new and improved fluid-admitting means adapted for selectively establishing isolated communication with potentially producible earth formations of varying degrees of competency. The fluid-admitting means include a sealing pad with a central opening arranged for normally providing unrestricted communication with condition-measuring means and sample-collecting means on the testing apparatus so long as the isolated portion of the borehole wall remains intact. Should, however, the formation wall being eroding, a fluid-sampling probe with a closed forward end is operatiely advanced through the central opening into the formation well and, in cooperation with normally open valve means, blocks further communication around the probe and instead establishes communication with the condition-measuring and sample-collecting means on the tool by way of normally isolated filter means on the probe member.

The novel features of the present invention are set forth with particularity in the appended claims.

The invention, together with further objects and advantages thereof, may be best understood by way of the following description of exemplary apparatus employing the principles of the invention as illustrated in the accompanying drawings, in which.

Figure 1:
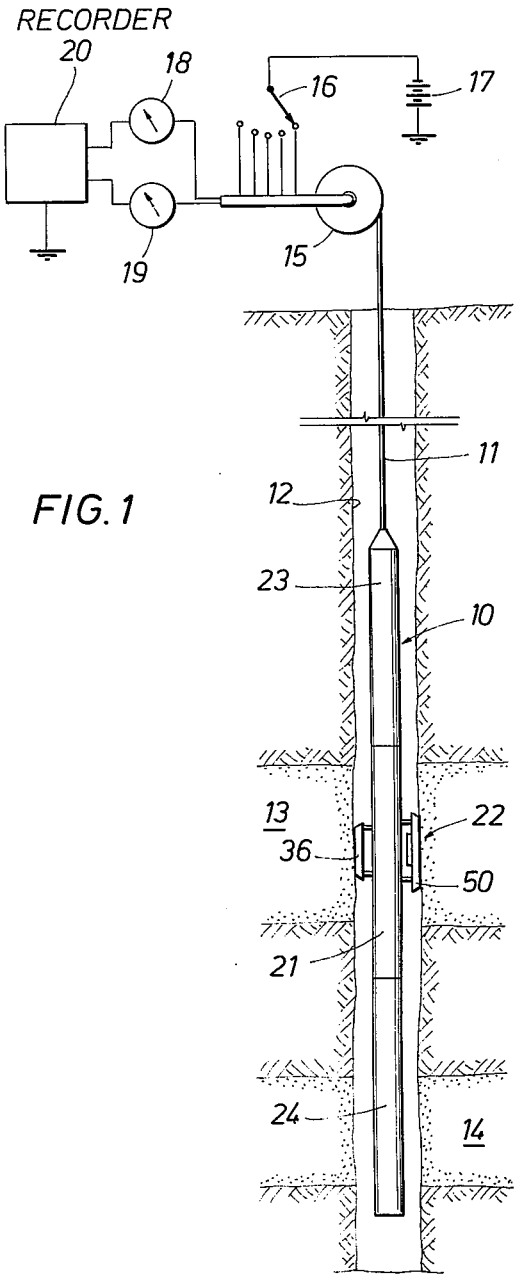
FIG. 1 depicts new and improved fluid sampling apparatus of the present invention as it might appear while operating within a borehole.

Turning now to FIG. 1, formation-testing apparatus 10 incorporating the principles of the present invention is shown suspended from a multi-conductor cable 11 in a well bore such as an uncased borehole 12 penetrating one or more potentially producible earth formations as at 13 and 14. As is customary, the cable 11 is spooled from a winch 15 at the surface and is terminated at typical surface equipment including a selectively controlled switch 16, a power source 17, and one or more indicating and recording devices as at 18–20. In its preferred embodiment, the new and improved tool 10 includes an elongated body 21 which carries fluid-admitting means 22 arranged in accordance with the present invention as well as a typical hydraulic control system 23 and a condition-measuring and fluid-sampling system 24 respectively enclosed in the upper and lower portions of the tool body. Accordingly, as illustrated, the new and improved apparatus 10 has been positioned adjacent to the formation interval 13 and is in readiness for measuring one or more fluid or formation characteristics and, if desired, subsequently collecting a sample of any producible connate fluids contained in that formation.

Figure 2:
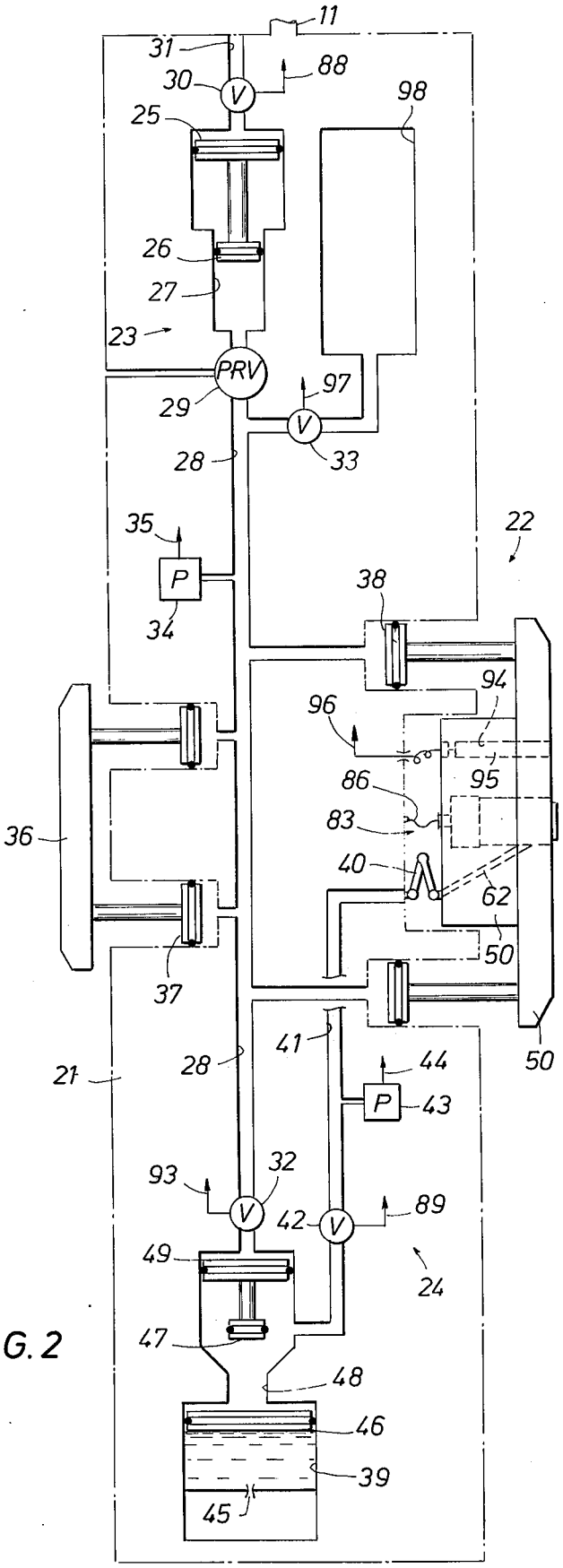
FIG. 2 is a somewhat-schematic representation of a preferred embodiment of the fluid-sampling apparatus shown in FIG. 1.

The selectively operable hydraulic system 23 of the new and improved formation-testing tool 10 is preferably arranged in accordance with the system described in Pat. No. 3,011,554 issued to Robert Desbrandes which patent is hereby incorporated by reference. As schematically illustrated in FIG. 2, therefore, the hydraulic system 23 includes pressure-responsive or hydraulic actuating means such as a piston actuator 25 that is coupled to a reduced-diameter piston 26 disposed in an oil-filled pressure chamber 27 arranged in the upper portion of the tool body 21. A hydraulic line 28 in the tool body 21 is preferably coupled to the pressure chamber 27 by means of a pressure-regulating valve 29 (such as that shown in FIG. 8 of the aforementioned Desbrandes patent) arranged for maintaining the hydraulic fluid in the hydraulic line at a selected elevated pressure above the hydrostatic pressure of the fluids in the borehole 12. To actuate the hydraulic system 23, a selectively-operated normally-closed valve 30 (such as that shown in FIG. 4 of the Desbrandes patent) is arranged in a conduit 31 for controlling the admission of borehole fluids to the piston actuator 25. As will be subsequently described in more detail, the hydraulic system 23 further includes two selectively-controlled normally-closed valves 32 and 33 (such as the one shown in FIG. 7 of the Desbrances patent) which are respectively connected to the hydraulic line 28 as well as a pressure-responsive transducer 34 (such as shown in FIG. 9 of the Desbrandes patent) that is arranged for providing signals representative of the hydraulic pressure to the surface monitor 18 and the recorder 20 by way of a conductor 35 in the cable 11.

To anchor the new and improved formation-testing tool 10 while a selected formation, as at 13, is being tested, the tool is further provided with means such as a wall-engaging member 36 which is mounted on a pair of laterally movable hydraulic actuators, as at 37, and arranged for selective movement from the back side of the tool body 21 into anchoring engagement with an adjacent wall of the borehole 12. Although the new and improved fluid-admitting means 22 could just as well be fixed on the forward side of the body 21, in the preferred embodiment of the tool 10 a second pair of laterally movable hydraulic actuators, as at 38, are arranged on the tool body for selectively extending the fluid-admitting means into sealing engagement with an adjacent wall of the borehole 12. Alternatively, the wall-engaging member 36 and its hydraulic actuators 37 could be omitted by arranging the hydraulic actuators 38 to have a sufficiently long stroke for anchoringly engaging the rear of the tool body 21 against one wall of the borehole 12 whenever the fluid-admitting means 22 are extended into sealing engagement with the opposite borehole wall. As illustrated, however, it is preferred that the fluid-admitting means 22 and the tool-anchoring member 36 are both arranged for extension so as to minimize the overall stroke lengths of the hydraulic actuators 37 and 38.

The condition-measuring and fluid-sampling system 24 of the new and improved tool 10 includes an enlarged sample-collecting chamber 39 which is coupled to the fluid-admitting means 22 by means such as a flexible or pivoted conduit 40 and a flow passage 41 in the body 21 that is communicated to the sample chamber by way of a normally closed valve 42 similar or identical to the hydraulic line valves 32 and 33. To provide measurements representative of one or more properties of a fluid within the passage 41, condition-responsive means are provided such as a pressure transducer 43 similar or identical to the transducer 34 which is coupled to the flow passage and connected by way of an electrical conductor 44 in the cable 11 to the surface monitor 19 and the recorder 20. As fully described in the aforementioned Desbrandes patent, the sample-collecting chamber 39 is divided by an orifice 45 arranged for regulating the rate at which a quantity of water initially disposed in the upper half of the chamber below a floating piston 46 will be discharged into the initially empty lower half of the chamber as entering connate fluids displace the floating piston downwardly. To seal off the chamber 39 once a sample is collected, a valve member 47 (such as shown in FIG. 10 of the Desbrandes patent) is arranged for being latched into seating engagement on a seat 48 between the upper end of the sample chamber and the discharge end of the flow passage 41; and the normally closed hydraulic valve 32 is connected to a hydraulic actuator, as at 49, coupled to the valve member.

Figure 3:
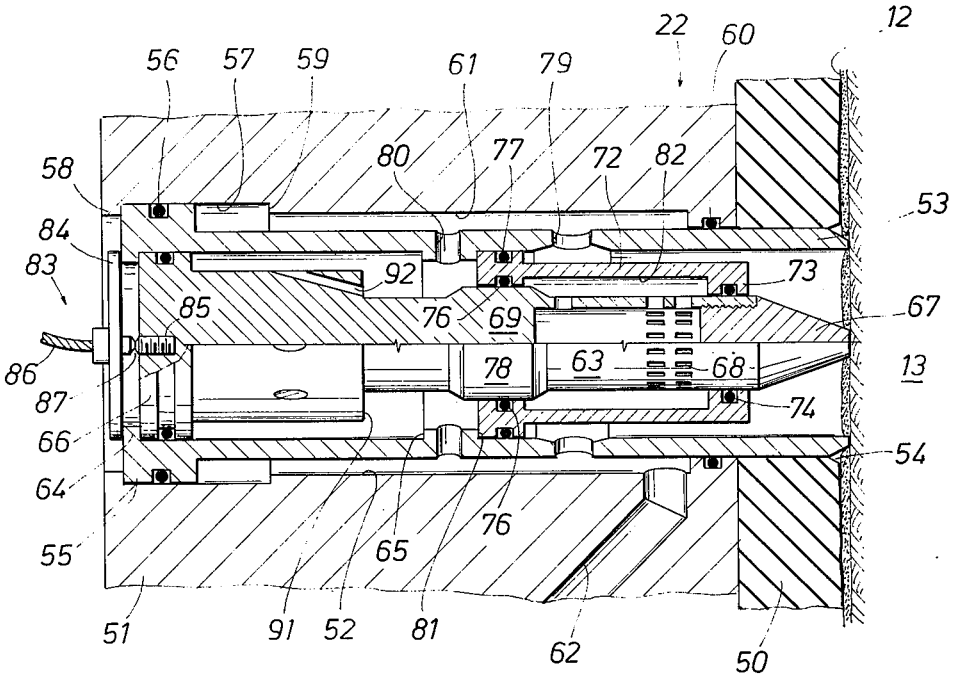
FIG. 3 illustrates the fluid-admitting means of the present invention as it will appear during a typical testing operation of a relatively-competent earth formation.

Turning now to FIG. 3, a preferred embodiment of the new and improved fluid-admitting means 22 is illustrated. As shown there, the fluid-admitting means 22 include an elongated sealing pad 50 which is mounted on the hydraulic actuators, as at 38, and cooperatively arranged to be moved into engagement with the wall of the borehole 12 for isolating the contacted portion of the borehole wall from the borehole fluids. An enlarged support body 51 mounted on the back of the pad member 50 is provided with a laterally aligned bore 52 cooperatively arranged for carrying an elongated tubular probe 53 having its open forward end projecting through a central opening 54 in the sealing pad and an outwardly enlarged rearward portion 55 sealingly engaged, as by an O-ring 56, within an enlarged counterbore 57 at the rear of the lateral bore which defines spaced stops or shoulders 58 and 59 limiting the travel of the probe. A sealing member, such as an O-ring 60, is cooperatively arranged within the forward portion of the lateral bore 52 and engaged with the forward portion of the tubular probe 53 for defining an isolated annular space 61 in the lateral bore between the O-rings 56 and 60 which is communicated by way of a flow passage 62 in the support body 51 and the conduit 40 to the flow passage 41 in the tool body 21.

Figure 4:
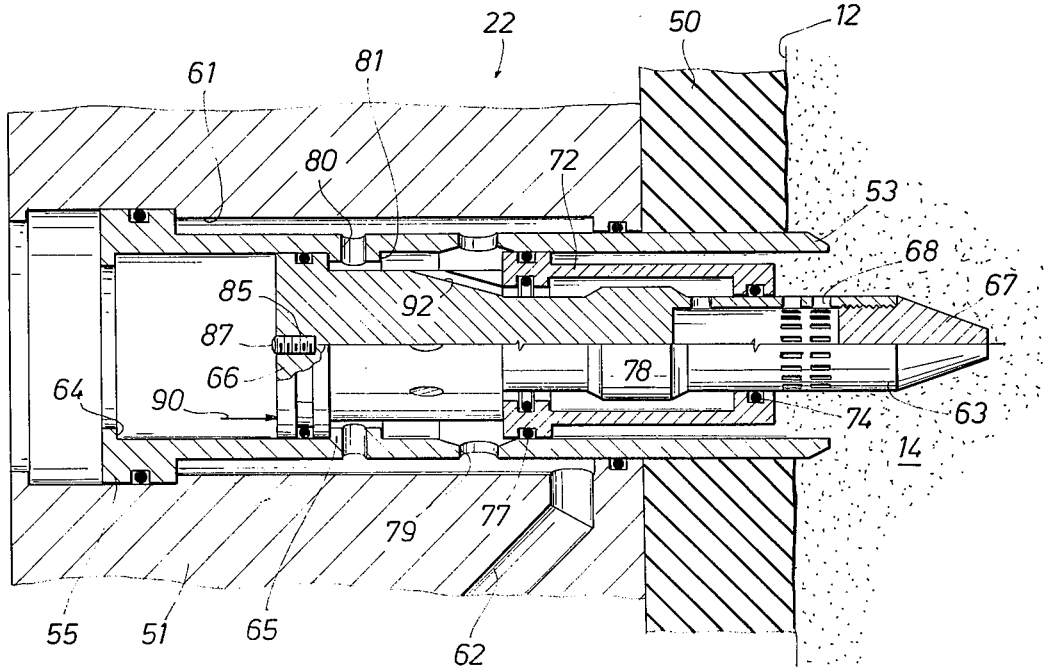
FIG. 4 is a view similar to FIG. 3 but depicts the new and improved fluid-admitting means while operating during the testing of a highly-unconsolidated formation.

Of particular significance, it will be noted by comparison of FIGS. 3 and 4, that the new and improved fluid-admitting means 22 further include a second or inner probe member 63 which is coaxially mounted within the first or outer probe 53 and cooperatively arranged for axial movement therein between retracted and extended positions as defined by spaced shoulders 64 and 65 on the outer member which are adapted for alternate engagement by an outwardly enlarged rearward portion 66 of the inner member. In contrast to the outer probe 53, however, the forward end of the inner probe 63 is blocked, as by a threaded plug 67; and that portion of the inner probe immediately behind the plug is arranged for carrying filtering means such as a plurality of small holes or slits 68 in the wall of the inner probe. For reasons which will be subsequently explained, the rearward end of the inner probe 63 is also blocked, as at 69, to define an enclosed chamber 70 in the forward portion of the probe which is accessible only by way of the filter passages 68 and a lateral port 71 located to the rear of the passages.

To complete the new and improved fluid-admitting means 22, valve means are further included such as an elongated tubular member 72 which is coaxially mounted between the probe members 53 and 63 and provided with an inwardly-enlarged forward portion 73 carrying an internal sealing member, such as an O-ring 74, that is normally sealingly engaged with the exterior portion of the inner probe ahead of the filter passages 68. In a similar fashion, the rearward portion of the valve member 72 is inwardly and outwardly enlarged, as at 75, and arranged for carrying internal and external sealing members, such as O-rings 76 and 77, which, so long as the valve member is retracted, are respectively engaged with an enlarged-diameter intermediate portion 78 of the inner probe 63 located to the rear of the port 71 and an intermediate portion of the outer probe 53 located between a spaced pair of lateral ports 79 and 80 arranged in the latter member. A forwardly facing shoulder 81 is suitably located on the outer probe 53 ahead of the port 80 for defining the retracted position of the valve member 72.

Those skilled in the art will, of course, recognize that with the new and improved fluid-admitting means 22 arranged as described so far, the O-rings 74 and 76 on the valve member 72 will serve to isolate the annular space 82 between the valve member and the inner probe 63 so long as the latter O-ring is engaged with the enlarged surface 78. This will mean, therefore, that so long as the probe members 53 and 63 and the valve member 72 are in their respective retracted positions as depicted in FIG. 3, the annular space 82 as well as the chamber 70 within the inner probe will be at atmospheric pressure. Thus, as the new and improved formation-testing tool 10 is lowered into the borehole 12, the hydrostatic pressure of the fluids contained therein will be imposed on both ends of the valve member 72; and, by virtue of the differential area represented by the difference between the respective cross-sectional areas of those end portions 73 and 75 of the valve member carrying the O-rings 74, 76 and 77, there will be a net pressure-derived force serving to bias the valve member rearwardly against the internal shoulder 81 on the outer probe member 53. This net pressure-derived force will, of course, be equal to the product of the above-identified differential area times the difference between the borehole hydrostatic pressure and the pressure within the annular space 82, which latter pressure will ordinarily be atmospheric pressure. Thus, both the valve member 72 and the outer probe 53 will normally be urged toward their respective retracted positions by this unbalanced pressure-derived force.

At the same time it will be recognized that the inner probe 63 will also be subjected to the same unbalanced pressure-derived force which will, however, tend to move it forwardly toward its extended position. This unbalanced force will be acting on the rear side of the enlarged shoulder 78 on the inner probe 63.

Thus, to temporarily hold the inner probe 63 in its retracted position until the tool 10 is operated to place the fluid-admitting means 22 into communication with an earth formation, retaining means, as shown generally at 83, are cooperatively arranged for releasably securing the inner probe from movement in relation to the body 21 as a result of the aforementioned unbalanced pressure force. As depicted in FIGS. 2 and 3, one release arrangement for securing the inner probe 63 against movement from its retracted position until the nose of the probe is against the wall of the formation 13 includes a transversely oriented member 84 which is releasably attached to the base of the inner probe (as by a threaded stud 85) and positioned with the opposite ends of that member bridging the counterbore 57 at the rear of the pad-support body 51 or straddling the enlarged end portion 55 of the outer probe 53 so as to normally hold the inner member in its retracted position. Then, by means of an actuating link, such as a short, initially relaxed cable 86 arranged between the tool body 21 and the retaining member 84, the stud 85 can be caused to fail, as at 87, as the sealing pad 50 is extended and tightens the cable.

It will, however, be appreciated that the cable 86 could be alternatively attached to the tool-anchoring member 36 to similarly accomplish the release of the inner member 63. This alternate arrangement would, of course, be necessary where the hydraulic actuators 38 are not employed with the tool 10 so that the fluid-admitting means 22 are not extendible.

A second alternate release arrangement could also be provided by eliminating the cable 86 and either leaving the transverse member 84 in its depicted position or else extending the member so it straddles the counterbore 57. In either case, the weakened portion 87 would have to be sized to initially secure the outer and inner probes 53 and 63 against movement under the effects of hydrostatic pressure before the tool 10 is anchored in the borehole 12. This would, of course, mean that with this arrangement, the effective cross-sectional area of the rear piston portions of the probes 53 and 63 would have to be adequately sized for driving the probes forwardly with sufficient force to break the weak point 87 when the sealing pad 50 is sealingly engaged and the motivating pressure differential is only the difference between the hydrostatic borehole pressure and the formation pressure.

Accordingly, it will be appreciated that as the new and improved tool 10 is lowered into the borehole 12, the several elements of the fluid-admitting means 22 will remain in their respective positions as illustrated in FIG. 3 inasmuch as the hydrostatic pressure of the borehole fluids will be imposed on both ends of each of the several elements and the retainer means 83 will hold the inner probe 63. It will, of course, be noted that since the forward end of the outer probe 53 is open, the borehole fluids will fill the flow passage 41 above the control valve 42 so that the pressure transducer 43 will be initially effective for providing indications on the surface monitor 19 and the recorder 20 of the hydrostatic pressure of the fluids in the borehole 12.

Once the formation-testing tool 10 reaches a position adjacent to a formation, as at 13, which is to be tested, the tool is halted and the control switch 16 is advanced to its first operating position. Advancement of the switch 16 will, of course, be effective for connecting the power supply 17 to the valve 30 by way of a cable conductor 88 to admit the borehole fluids to the pressure actuator 25. As fully described in the aforementioned Desbrandes patent, opening of the normally closed valve 30 will enable the piston 26 to develop an increased hydraulic pressure in the hydraulic line 28 which, as determined by the setting of the regulator 29, will be sufficiently greater than the borehole hydrostatic pressure to extend the fluid-admitting means 22 and the tool-anchoring member 36 with sufficient force for firmly anchoring the tool 10 in the borehole 12 and urging the sealing pad 50 against the adjacent borehole wall. The retaining means 83 will also have functioned to release the inner probe 63 at this time.

Accordingly, as depicted in FIG. 3, once the sealing pad 50 is firmly seated against the wall of the borehole 12, it will be recognized that the forward space defined by the central opening 54 in the pad will be isolated from the fluids in the borehole. Thus, if the formation being tested, as at 13, contains producible connate fluids, the pressured borehole fluids initially trapped in the flow line 41 above the normally closed valve 42 will, in time, move into the formation until their pressure is at least about equal to the formation pressure of the connate fluids. This pressure equalization will, of course, be indicated by the surface monitor 19 and shown on the recorder 20.

Those skilled in the art will, therefore, appreciate that should the aforementioned pressure measurements indicate that the formation 13 is potentially productive, it will be advantageous to also obtain a representative sample of the connate fluids in the formation. Thus, to obtain a sample of such fluids, the control switch 16 is advanced to its next position for connecting the power supply 17 to a cable conductor 89 and, thereby, opening the flow line valve 42. This action will, of course, be effective for coupling the initially empty sample chamber 39 to the flow line 41 and the now-isolated central opening 54 in the sealing pad 50.

It should be noted at this point that ordinarily there is little or no difficulty in obtaining a pressure measurement of the connate fluids in a formation, as at 13 or 14, with the new and improved testing tool 10 since the flow passage 41 is filled with the pressured fluids in the borehole 12. Thus, when the fluid-admitting means 22 are initially placed in communication with a formation, as at 13 or 14, the isolated portion of the wall of the borehole 12 will generally remain intact. As is recognized by those skilled in the art, however, opening of the flow line valve 42 will immediately subject the isolated wall portion of the borehole 12 to a drastic pressure reduction since the sample chamber 39 is ordinarily at atmospheric pressure. If the formation, as at 13, is relatively competent, this sudden pressure reduction will cause any producible connate fluids in the formation to surge into the fluid-admitting means 22; but, except for an initial influx of mudcake particles trapped within the central opening 54, there will ordinarily be no significant erosion of the formation wall. This, however, poses no particular operational problem since the several passages 40, 41 and 62 can be readily sized for allowing the dislodged mudcake particles to easily pass on through these passages and enter the sample chamber 39. Thus, if the formation 13 is firm or substantially competent so that few, if any, formation particles are eroded therefrom as the sample chamber 39 is filling, the new and improved fluid-admitting means 22 will remain in the general position illustrated in FIG. 3.

However, as previously discussed, it is not at all uncommon for a formation, as at 14, which is being tested to be so incompetent or unconsolidated that opening of the flow line valve 42 causes a rapid erosion of formation materials from the isolated wall portion of the borehole 12. In such cases, if it were not for the new and improved fluid-admitting means 22, the rapid surge of formation fluids would quickly erode the adjacent face of the isolated portion of the borehole wall and rapidly cause the sealing pad 50 to lose its sealing engagement before an adequate fluid sample can be obtained. Accordingly, to achieve the objects of the present invention, it will be appreciated that the several telescoped members 53, 63 and 72 are cooperatively arranged to move in relation to one another in response to a reduction in the pressure in the isolated central pad opening 54 and an accompanying influx of loose formation materials for allowing at least the inner probe 63 to correspondingly advance into the adjacent formation 14 and quickly halt further erosion of the borehole wall. It will be recognized, of course, that any mudcake particles initially confined within the central opening 54 will have already passed on through the outer probe 53 before the inner probe 63 is extended and the valve member 72 functions to close off the outer probe. Thus, in keeping with the objects of the present invention, there is no opportunity for the loosened mudcake particles to plug the filter openings 68.

Thus, as best seen in FIG. 4, whenever there is a significant erosion of loosened formation particles which is sufficient to create a void of adequate size to accommodate the nose 67 of the inner probe 63, the hydrostatic pressure acting, as at 90, on the enlarged rearward portion 66 of the probe will be effective for correspondingly advancing the probe into the isolated wall of the formation 14 as it is eroded. It should be noted that since the formation pressure must necessarily be less than the hydrostatic pressure at that depth in the borehole 12, the inner probe 63 will be free to advance into the formation 14 once its nose 67 is no longer restrained by the borehole wall as was the case with the testing operation depicted in FIG. 3. Although the erosion of the borehole wall may initially allow only the inner probe 63 to move forward, it will, of course, be recognized that this erosion may also cause the cuter probe 53 to simultaneously advance into the formation 14 by virtue of the hydrostatic pressure acting on the enlarged rear portion 55 of the outer member.

In any event, in keeping with the objects of the present invention, it will be appreciated that the advancement of the probes 53 and 63 will be effective for maintaining the fluid-admitting means 22 in isolated communication with the formation 14 thereby preventing the continued erosion of loose formation materials which would otherwise allow the higher-pressured borehole fluids to quickly bypass the pad 50. Accordingly, to further accomplish the objects of the present invention, should such erosion begin, the new and improved fluid-admitting means 22 are cooperatively arranged for closing off further communication through the outer probe 53 and instead diverting any further flow of connate fluids through the inner probe 63. Thus, as will be recognized by a comparison of FIGS. 3 and 4, once the nose 67 of the inner probe 63 is no longer engaged against the wall of the formation 14, the inner probe will be immediately advanced into the formation by virtue of the hydrostatic pressure of the borehole fluids acting on the enlarged rearward portion 66 of the probe. At the same time, it will be recognized that the formation pressure imposed on the forward end 73 of the valve member 72 will be effective for initially urging the valve member rearwardly against the shoulder 81 so that the advancement of the inner member 63 will serve to carry the filter openings 68 beyond the O-ring 74. Then, once the inner member 63 is fully advanced in relation to the valve member 72 (as will be established by the co-engagement of a shoulder 91 on the probe and the rear portion 75 of the valve member), the formation 14 will now be communicated with the flow passage 62 solely by way of the filter openings 68, the port 71 in the inner probe, a suitably-located port 92 in the shoulder 91 and the port 79 in the outer probe 53. At the same time, further communication with the formation 14 through the outer probe 53 will now be blocked by virtue of the preceding shifting of the O-ring 77 ahead of the port 79 in the outer probe.

It should also be recognized that the inner probe 63 is free to advance into the formation 14 over a span of travel determined by the combined spacings between the shoulders 58 and 59 and the shoulders 64 and 65. Thus, although the inner probe 63 may not necessarily advance to its maximum extent, it will be free to do so should there be a substantial erosion of formation materials from the formation 14 before the outer probe 53 is closed. In any event, once the inner probe 63 is at least partially extended, further erosion of the formation 14 will be quickly halted since the loose formation particles can no longer pass through the filter openings 68. As a result, the sealing pad 50 will be able to retain its sealing engagement against the wall of the borehold 12 so as to continue to isolate the inner probe 63 from the borehole fluids as the sample chamber 39 is filling.

Once the pressure monitor 19 indicates that a sample has been collected in the sample chamber 39, the control switch 16 is advanced again for connecting a cable conductor 93 to the power supply 17 so as to open the hydraulic valve 32. This action will be effective for operating the actuator 49 to shift the valve member 47 to its latched position on the valve seat 48 to trap the collected sample in the chamber 39.

To retrieve the tool 10, it is, of course, necessary to retract the two wall-engaging members 36 and 50. It will be recognized, however, that since at least the face of the sealing pad 50 immediately surrounding the central opening 54 will be isolated from the fluids in the borehole 12, the sealing pad will often be retained against the borehole wall by a substantial pressure differential. Accordingly, in keeping with the Desbrandes patent, selective communication between the borehole fluids and the forward face of the sealing pad 50 is provided by a pressure-relief passage 94 which is extended through the body 51 and, as shown generally at 95, normally closed by a frangible plug which is adapted to fail upon detonation of an electrically initiated explosive. Thus, should it be believed or discovered that the sealing pad 50 is tightly held against the borehole wall by a pressure-derived force of such magnitude that the suspension cable 11 might be unduly tensioned in an attempt to pull the tool 10 free, the control switch 16 can be selectively operated to connect the power source 17 to a cable conductor 96 leading to the explosive plug 95. This will, of course, communicate the forward face of the sealing pad 50 with the fluids in the borehole 12 so as to equalize any pressure differential holding the pad against the borehole wall.

In any event, whether or not the explosive plug 95 is actuated, the two wall-engaging members 36 and 50 are retracted by operating the control switch 16 to connect the power source 17 to a cable conductor 97 connected to the hydraulic valve 33. Opening of the valve 33 will, therefore, communicate the hydraulic line 28 with an initially empty chamber 98 which is sized for accommodating a sufficient volume of the hydraulic fluid contained in the entire hydraulic system to allow the system pressure to drop to about atmospheric pressure. Thus, once the valve 33 is opened, the hydrostatic pressure of the fluids in the borehole 12 will be effective for retracting the hydraulic actuators 37 and 38 as the pressure is reduced in the hydraulic line 28. Once the wall-engaging members 36 and 50 are retracted, the tool 10 is, of course, in readiness to be retrieved from the borehole 12 along with the entrapped fluid sample in the sample chamber 39.

Accordingly, it will be appreciated that the present invention has provided new and improved formation-testing apparatus for reliably obtaining one or more measurements of a fluid or formation characteristic, such as the pressure of formation fluids, as well as at least one sample of such fluids when desired. By arranging the new and improved fluid-admitting means on the testing tool of the present invention to include an unrestricted first sample probe, when the fluid-admitting means are initially placed into communication with a formation mudcake and other loose plugging materials will be free to pass through the probe to avoid premature disruption of subsequent measurements. Should, however, the formation being tested be of a relatively incompetent composition so that the production of connate fluids therefrom causes undue erosion of the isolated borehole wall, the new and improved fluid-admitting means of the present invention further include a second sample probe having filtering means arranged thereon which is cooperatively arranged to advance into the eroding borehole wall and valve means operative for blocking further flow through the first probe. In this manner, further pressure or flow communication will be diverted through the second probe with the filtering means thereafter being effective for halting further erosion of loose formation materials so that measurements and fluid samples can be subsequently obtained.

While only a particular embodiment of the present invention has been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. Apparatus adapted for testing earth formations of different degrees of competency and comprising:

a body adapted for suspension in a well bore penetrating such formations;

sample-collecting means cooperatively arranged on said body for receiving samples of connate fluids produced from such formations;

sealing means having a central opening therein cooperatively arranged on said body and adapted for sealing engagement with a well bore wall to isolate a portion thereof adjacent to said central opening from well bore fluids;

a tubular probe having a closed forward portion and cooperatively arranged for movement relative to said body from a normal retracted position to an extended position where said closed forward portion of said tubular probe is projected through said central opening and is ahead of said sealing means;

filtering means cooperatively arranged on an intermediate portion of said tubular probe and adapted for admitting connate fluids into the interior of said tubular probe and restraining loose formation materials from passing into the interior of said tubular probe whenever said tubular probe is in its said extended position;

first passage means adapted for providing communication between said sample-collecting means and said central opening;

second passage means adapted for providing communication between said sample-collecting means and the interior of said tubular probe;

probe-actuating means cooperatively arranged on said tubular probe and adapted for advancing said tubular probe toward its said extended position as loose formation materials are eroded away from an isolated wall portion of a well bore wall ahead of said closed forward portion of said tubular probe and enter said first passage means; and valve means cooperatively arranged for normally blocking communication through said second passage means and operable in response to movement of said tubular probe toward its said extended position for successively blocking further communication through said first passage means and opening communication through said second passage means.

2. The apparatus of claim 1 wherein said probe-actuating means include:

piston means on a rearward portion of said tubular probe and cooperatively arranged for advancing said tubular probe toward its said extended position in response to a pressure differential between well bore fluids and connate fluids entering said tubular probe as loose formation materials enter said first passage means.

3. The apparatus of claim 2 further including:

means releasably securing said tubular probe in its said retracted position at least until said sealing means are engaged with a well bore wall.

4. The apparatus of claim 1 further including:

pressure-monitoring means on said body and cooperatively arranged for providing signals representative of the pressure in said passage means.

5. Apparatus adapted for testing earth formations of different degrees of competency and comprising:

a body adapted for movement through a well bore penetrating such formations and having a sample passage arranged thereon;

sample-collecting means cooperatively arranged on said body for receiving samples of connate fluids produced from such formations;

sealing means cooperatively arranged on said body and adapted to be placed in sealing engagement against a well bore wall for isolating a portion thereof from well bore fluids;

a first tubular probe having an open forward portion extending through said sealing means and cooperatively arranged for providing unrestricted communication between said open forward portion of said first probe and an outlet port in an intermediate portion of said first probe and fluidly coupled to said sample passage;

a second tubular probe having a closed forward portion and an intermediate portion with means thereon defining a plurality of restricted filter openings between the exterior and interior of said second probe, said second probe being coaxially mounted in said first probe and cooperatively arranged for movement therein between a normal retracted position to an extended position where said closed forward portion of said second probe is projected from said open forward portion of said first probe and ahead of said sealing means;

probe-actuating means cooperatively arranged on said second probe and adapted for advancing said second probe toward its said extended position in response to the erosion of loose formation materials from an isolated portion of a well bore wall ahead of said closed forward portion of said second probe; and means including an annular valve member cooperatively arranged between said first and second probes and movable relative thereto between a first valving position covering said restricted filter openings and communicating said open forward portion of said first probe with said outlet port therein for selectively communicating said first probe with said sample passage whenever said second probe is in its said retracted position and a second valving position to successively block communication through said open forward portion of said first probe, uncover said filter openings, and communicate said interior of said second probe with said outlet port for selectively communicating said second probe with said sample passage whenever said second probe is moved toward its said extended position.

6. The apparatus of claim 5 further including:

pressure-monitoring means in said sample passage and cooperatively arranged for providing electrical signals representative of the pressure of fluids therein.

7. The apparatus of claim 5 further including:

means selectively operable for moving said sealing means into sealing engagement with a well bore wall.

8. The apparatus of claim 5 wherein said probe-actuating means include:

piston means on a rearward portion of said second probe and cooperatively arranged for advancing said second probe toward its said extended position in response to a pressure differential between well bore fluids and connate fluids entering said first probe as loose formation materials enter said sample passage.

9. The apparatus of claim 8 further including:

means releasably securing said second probe in its said retracted position at least until said sealing means are engaged with a well bore wall.

10. The apparatus of claim 8 further including:

means selectively operable for moving said sealing means into sealing engagement with a well bore wall; and means releasably securing said second probe in its said retracted position and operable upon movement of said sealing means into sealing engagement with a well bore wall for releasing said second probe for advancement toward its said extended position should loose formation materials begin entering said sample passage.

11. Fluid-sampling apparatus adapted for obtaining samples of connate fluids from earth formations of different degrees of competency and comprising:

a body adapted for suspension in a borehole penetrating one or more of such earth formations;

sample-collecting means on said body and including a sample chamber, a sample passage coupled to said sample chamber, and selectively operable valve means adapted for controlling communication through said sample passage to said sample chamber;

a wall-engaging sealing pad having a central opening therein and cooperatively mounted on said body for engagement with a borehole wall to isolate at least a portion thereof surrounding said central opening from borehole fluids;

fluid-admitting means coupled to said sample passage and cooperatively arranged for providing alternative communication paths between said sample passage and an isolated portion of a borehole wall, said fluid-admitting means including a first tubular probe having an open forward portion arranged in said central opening and an intermediately-located first outlet port therein cooperatively arranged for providing a substantially unrestricted first communication path, a second tubular probe having a closed forward portion and including intermediately located filter means thereon providing a plurality of filter passages into the interior of said second probe and a second outlet port located to the rear of said filter passages for providing a selectively restricted second communication path, said second probe being coaxially mounted in said first probe and cooperatively arranged for movement therein between a retracted position and an extended position where at least some of said filter passages are ahead of said forward open portion of said first probe, and valve means between said first and second probes and including an annular valve member coaxially arranged between said probes and movable relative thereto between a first valving position covering said filter passages and said second outlet port for coupling said first communication path to said sample passage and a second valving position for closing said open forward portion of said first probe and uncovering said filter passages and said second outlet port for coupling said second communication path to said sample passage; and actuating means operable upon flow of loose formation materials from an isolated portion of a borehole wall through said first communication path for advancing said second probe toward its said extended position and moving said valve member to its said second valving position for blocking said first communication path and opening said second communication path.

12. The fluid-sampling apparatus of claim 11 wherein said actuating means include:

piston means on a rearward portion of said second probe and cooperatively arranged for advancing said second probe toward its said extended position as loose formation materials enter said sample passage in response to a pressure differential between borehole fluids and connate fluids entering said first probe.

13. The fluid-sampling apparatus of claim 12 further including:

means releasably securing said second probe in its said retracted position at least until said sealing pad is engaged with a borehole wall.

14. The fluid-sampling apparatus of claim 11 further including:

pressure-monitoring means in said sample passage and cooperatively arranged for providing electrical signals representative of the pressure of fluids therein.

15. The fluid-sampling apparatus of claim 11 further including:

means on said body selectively operable for moving said sealing pad into sealing engagement with a borehole wall.

16. The fluid-sampling apparatus of claim 11 wherein said first probe is also movable in relation to said body between retracted and extended positions and said actuating means include:

first and second piston means respectively mounted on the rearward portions of said first and second probes and cooperatively arranged for advancing said probes to their said extended positions as loose formation materials enter said sample passage in response to a pressure differential between borehole fluids and connate fluids entering said first probe.

17. The fluid-sampling apparatus of claim 16 further including:

means releasably securing said second probe in its said retracted position at least until said sealing pad is engaged with a borehole wall.

18. Fluid-sampling apparatus adapted for obtaining samples of connate fluids from earth formations of different degrees of competency and comprising:

a body adapted for suspension in a borehole penetrating one or more of such earth formations;

sample-collecting means on said body and including a sample chamber, a sample passage coupled to said sample chamber, and selectively operable valve means adapted for controlling communication through said sample passage to said sample chamber;

fluid-admitting means incuding a support member mounted on said body and having a lateral bore extending between the forward and rearward faces of said support member, a wall-engaging sealing pad mounted on said forward face of said support member and having a central opening aligned with said lateral bore, a tubular first probe coaxially mounted in said lateral bore and having an open forward portion in said central opening and an intermediate portion with an outlet port therein, first and second sealing means between said support member and said first probe for defining an enclosed annular space around said intermediate portion of said first probe, a second probe having a closed forward end and an intermediate portion thereof defining a plurality of restricted filter passages and an outlet port therebehind opening into an enclosed chamber, said second probe being adapted for movement relative to said first probe between a normal retracted position and an extended position where said closed forward end of said second probe and said filter passages are at least partially projected from said open forward portion of said first probe, an annular valve member coaxially mounted between said first and second probes and having a rearward valve portion with outwardly facing and inwardly facing sealing means thereon sealingly engaged with said first and second probes respectively and a forward valve portion with inwardly facing sealing means thereon sealingly engaged with said second probe, said valve member being adapted for movement relative to said first probe upon extension of said second probe between a first valving position where said outwardly facing sealing means are to the rear of said outlet port in said first probe for communicating said annular space with said open forward portion of said first probe and said forward and rearward inwardly facing sealing means are respectively sealingly engaged with forward and rearward adjacent portions of said second probe ahead of and to the rear of said filter passages and said outlet port therein for blocking communication into said enclosed chamber and a second valving position where said outwardly facing sealing means on said valve member are ahead of said outlet port in said first probe for blocking communication between said annular space and said open forward portion of said first probe and said forward inwardly facing sealing means are between said filter passages and said outlet port upon extension of said second probe for opening a restricted communication path through said filter passages into said enclosed chamber and on through a bypass passage arranged in a portion of said extended second probe adjacent to said rearward inwardly-directed sealing means into said annular space by way of said outlet port in said first probe;

pad-actuating means operable for placing said sealing pad into engagement with a borehole wall for isolating a portion thereof surrounding said central opening from borehole fluids;

passage means intercoupling said annular space and said sample passage; and probe-actuating means operable upon flow of loose formation materials from an isolated portion of a borehole wall for advancing said second probe toward its said extended position and carrying said valve member from its said first valving position to its said second valving position for halting the further flow of loose formation materials once said restricted communication path is opened.

* * * * *